United States Patent [19]

Decker

[11] Patent Number: 4,685,832

[45] Date of Patent: Aug. 11, 1987

[54] UNDERGROUND PIPE AND CABLE LAYING MACHINE

[76] Inventor: William J. Decker, 8554 S. Slope Rd., Santee, Calif. 92071

[21] Appl. No.: 767,354

[22] Filed: Aug. 19, 1985

[51] Int. Cl.[4] ..... E02F 5/10; F16L 1/02

[52] U.S. Cl. ..... 405/184; 405/182

[58] Field of Search ..... 405/182, 184, 174, 180, 405/183; 37/193

[56] References Cited

U.S. PATENT DOCUMENTS

| | | | |
|---|---|---|---|
| 3,363,424 | 1/1968 | Kaercher | 405/184 |
| 3,371,495 | 3/1968 | Kaercher | 405/184 |
| 3,760,595 | 9/1973 | Stewart et al. | 405/184 |
| 3,914,948 | 10/1975 | Kaercher | 405/184 |
| 4,448,567 | 5/1984 | Tsuda | 405/184 X |

FOREIGN PATENT DOCUMENTS

| | | | |
|---|---|---|---|
| 1184987 | 7/1959 | France | 405/184 |

*Primary Examiner*—David H. Corbin

*Attorney, Agent, or Firm*—Charmasson & Holz

[57] ABSTRACT

An apparatus for burying filiform objects such as ducts, conduits, cables and the like into the ground. The apparatus has the general appearance of a gasoline-powered manually-driven soil tiller with a V-shaped blade extending into the ground to a predetermined depth. The blade is given a fore-and-aft oscillating movement which temporarily slices a pie-shaped section of the soil as the apparatus progresses over the ground.

A chinese finger mounted on the apex of the blade is used to crimp the end of the filiform object which is then pulled under the sliced soil section. Manually controlled clutches allowing the operator to separately activate the forward motion of the apparatus and the vibrating motion of the blade.

8 Claims, 12 Drawing Figures

UNDERGROUND PIPE AND CABLE LAYING MACHINE

BACKGROUND OF THE INVENTION

This invention relates to ditch-digging and pipe-laying equipment.

Irrigation systems using sprinkler heads or dripping tubes require the laying of pipes underground, both for aesthetic reasons and for limiting evaporation. Automatic irrigation systems using solenoid controlled valves requires a network of electrical cables which are often buried side by side with the water carrying pipes.

The common method for laying irrigation pipes and control cables underground is to dig a narrow trench to a depth of about twenty centimeters; to lay the pipe or cable into the trench; then to cover them with the soil previously removed from the trench. This operation requires a considerable amount of labor. The existing turf is partially destroyed, the disturbance of the soil often leaves a permanent scar, which may last for several months until the soil settles back to its original compactness.

SUMMARY OF THE INVENTION

The main purpose of the invention is to provide a means for digging a passage underground and for laying a pipe or cable or both, in one single operation.

Another purpose of the invention is to bury those objects in the ground without disturbing the surface vegetation or the general appearance of the ground surface.

These and other useful objects are achieved by means of an apparatus which progresses above ground while driving a V-shaped blade which extends into the soil to a predetermined depth. An oscillating fore-and-aft motion is imparted to the blade, which causes it to loosen a V-shaped section of the soil. A pipe or cable having one of its extremities attached to the apex of the blade is pulled under the loosened soil section.

DESCRIPTION OF THE PREFERRED EMBODIMENT OF THE INVENTION

Figure 1:
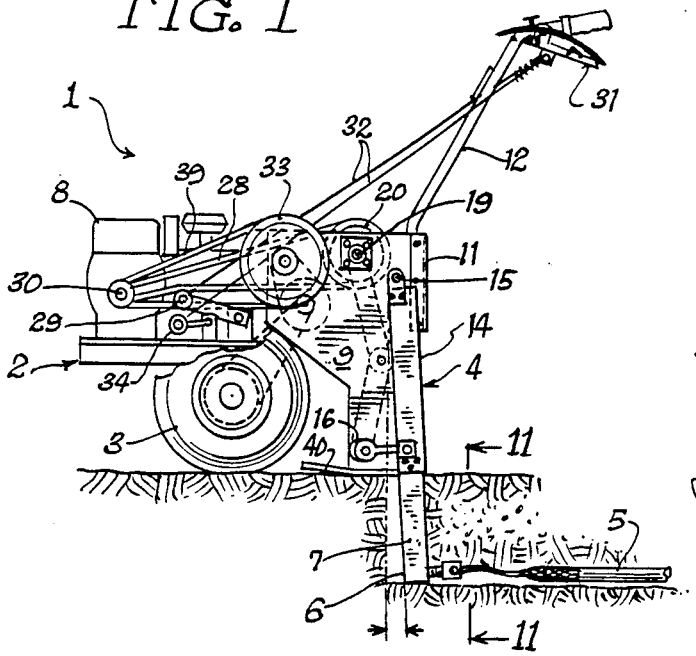
FIG. 1 is a side view of the pipe and cable laying apparatus.
Figure 2:
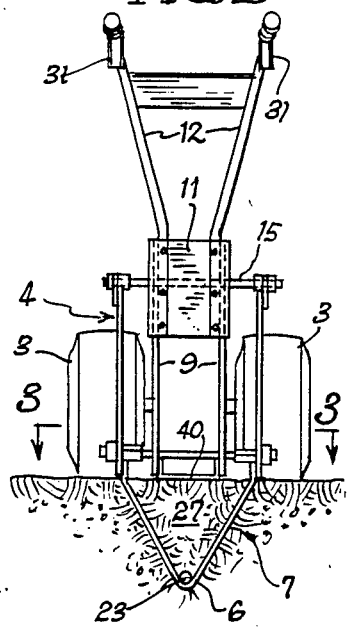
FIG. 2 is a back view thereof.
Figure 4:
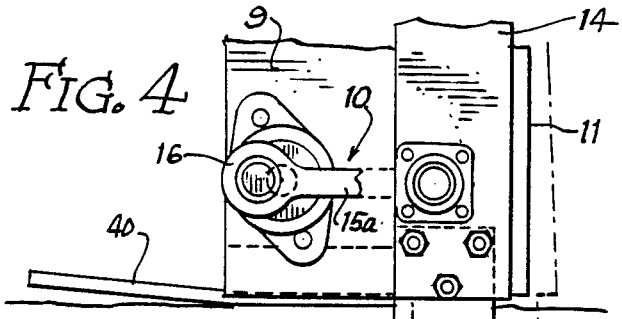
FIG. 4 is a detailed side view of the blade driving mechanism.
Figure 3:
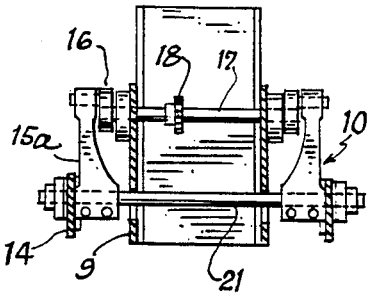
FIG. 3 is a partial cross-sectional view taken along line 3—3 of FIG. 2.
Figure 5:
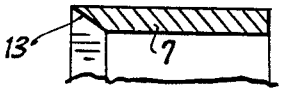
FIG. 5 is a cross-sectional view of a section of the blade taken along line 5—5 of FIG. 4.
Figure 5:
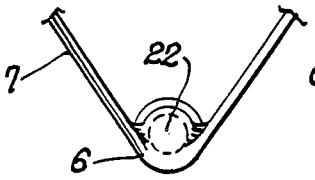
Figure 6:
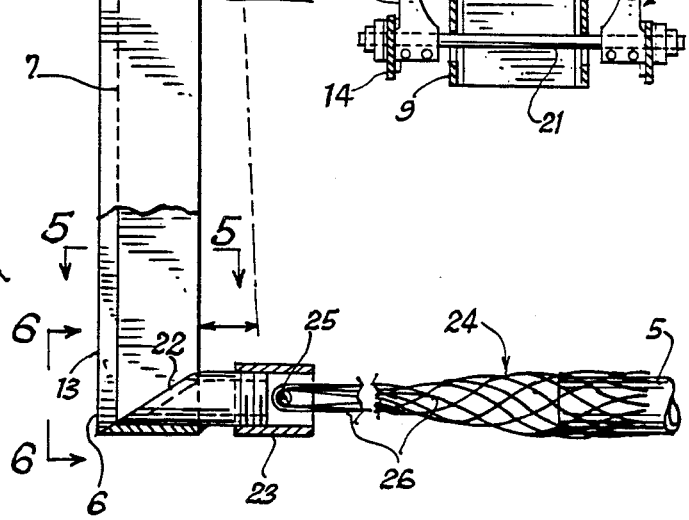
FIG. 6 is a frontal view of the blade apex.
Figure 7:
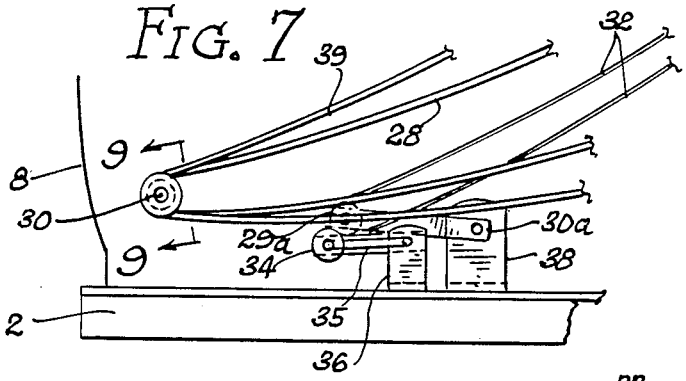
FIG. 7 is a partial side view of the clutch mechanism.
Figure 9:
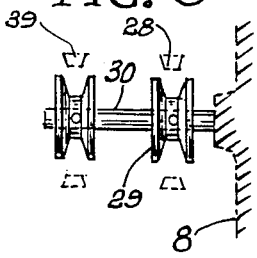
FIG. 9 is a detail view of the motor pulleys.
Figure 8:
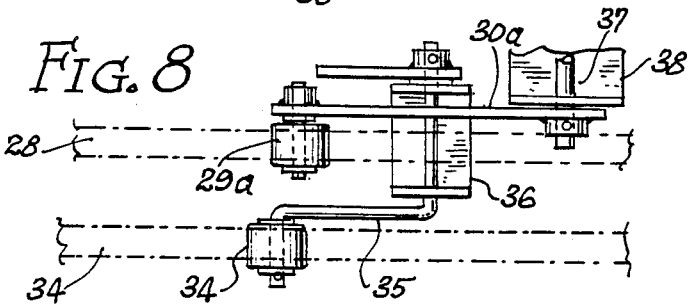
FIG. 8 is a top view of the clutch rollers.

With reference to the drawing, the pipe and cable laying apparatus 1 is shown comprising a carriage 2 supported by a pair of traction wheels 3 equipped with wide-print tires of the type used on tractor-mowers, and having in its rear section an oscillating blade assembly 4 which cuts a passageway at a predetermined depth under the ground surface for a pipe 5 which is dragged attached to the apex 6 of the blade 7. A gasoline engine 8 provides the power plant to drive both the traction wheels 3 and the blade assembly 4. In the rear half of the carriage 2 a pair of side plates 9 extending down near to the ground surface some distance behind the wheel base line, provides a framework supporting the blade assembly 4 and the reciprocating mechanism 10 which drives the blade. The rear edges of the side plates 9 are spanned by a back plate 11 which supports a pair of rear-extending handlebars 12.

The blade 7 is V-shaped and extends into the ground to a depth of about twenty centimeters. It presents a sharply tapered edge 13 to the forward direction of the apparatus. Each branch of the V-shaped blade is bolted to an oscillating arm 14 which is pivoted about axle 15 supported by the side plates 9. Each arm 14 is connected to an oscillating rod 15*a*. The oscillating movement of the rod 15*a* is created by an eccentric coupling 16 on axle 17. Axle 17 mounts a spur gear 18 which is chain driven from another axle 19 mounting drive pulley 20. A stabilizing bar 21 couples the two blade arms 14 and the ends of the two oscillating rods 15.

A bevel-capped end of tubing section 22 is welded at the apex 6 of the blade 7. The other threaded end of the section engages into a second tubing section 23 to which a crimping device 24 is attached by means of a bolt 25. The crimping assembly is formed by a chinese-finger made from a length of cross-woven netting 26 with ends looped around bolt 25. The netting crimps the end of the pipe 5 which is pulled behind the apparatus under the section of soil 27 sliced and loosened by the movement of the blade 4. Additional crimping assembly could be used to pull several pipes or cables in a single operation.

Figure 10:
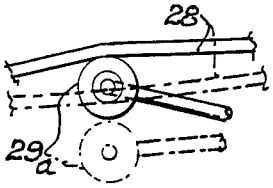
FIG. 10 is a diagramatic illustration of the clutch roller's movement.
Figure 11:
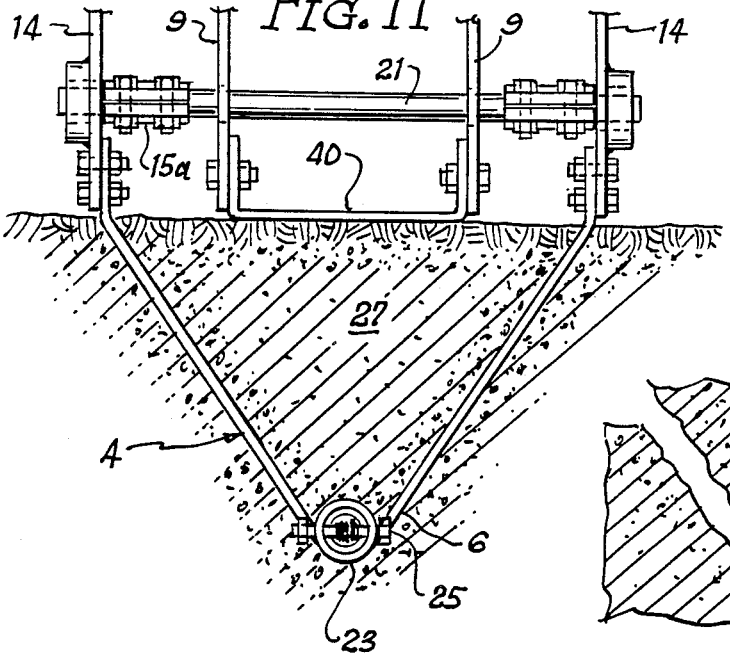
FIG. 11 is a back view of the blade assembly.
Figure 12:
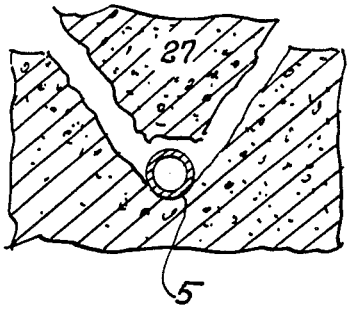
FIG. 12 is a cross-sectional view of a buried pipe.

The pulley 20 is driven by a transmission V-belt 28 loosely installed between pulley 20 and a drive pulley 29 on the engine drive shaft 30. The V-belt 28 which normally slips in its loose position may be tensioned by forcing against it roller 29*a* orthogonally mounted on a pivoting arm 30*a*. The lever is pulled from its loose non-driving position shown in dotted lines in FIG. 10 into a tensioning drive position shown in full lines in FIG. 10. The lever movement is tied to and controlled by a lever 31 attached to one of the handles 12 by way of a cable 32.

Similarly the tension of the belt 39 coupling the engine 8 to the wheel drive pulley 33 is controlled by another roller 34 and pivoting arm 35 mechanism. Arm 35 is supported by a U-shaped bracket 36. Arm 30*a* pivots about an axle 37 supported by another bracket 38. A chain drive couples the wheel drive pulley 33 to the wheels 3.

At the base of the side plates 9 a horizontal sole 40 slides on the ground. This sole is designed to help the operator in maintaining a steady and constant blade cutting depth.

It can now be understood that as the apparatus progresses over ground guided by its operator, the latter can activate or disactivate either the traction movement of the wheels or the soil-slicing oscillation of the blade by respectively operating one of the handle levers 31, which control the clutch mechanisms constituted by the loosely fixed belts and pressure roller assemblies.

The cable or conduit laying operation is started by attaching one end of a roll or length of conduit or cable, or both, to the lower end of the blade 6 by means of the crimping assembly 24. The blade is then activated to penetrate the soil down to the desired depth and the apparatus is guided along the desired path. Typically with such a machine weighing approximately one hundred kilograms, and powered by a eight horse-power engine, a length of PVC irrigation pipe of up to eighty meters can be pulled underground through cultivated soil, before the friction of the pipe against the surrounding soil becomes too great to overcome. Longer lengths of pipes may be obtainable by copiously watering the ground behind the path of the apparatus to lubricate the underground channel. The apparatus could be adapted for heavier duty such as burying large gauge conduit by increasing the weight of the device and its traction.

While the preferred embodiment of the invention has been described and modifications have been suggested, it should be understood that other embodiments could be devised based on the same principle of operation, which would remain within the spirit of the invention and the scope of the appended claims.

What is claimed is:

1. An apparatus for laying at least one filiform object such as a duct, conduit, cable or the like below the ground surface which comprises:

a carriage;

means for propelling said carriage above the ground surface;

a V-shaped cutting blade having two ribbon-like arms converging downwardly from the carriage to a tip at a predetermined depth into the ground, each of said arms being oriented to present its cutting edge in the forward direction of the carriage;

means at the lower tip of the blade for attaching one end of said filiform object;

means for imparting a fore-to-aft oscillating movement to the blade by reciprocally pivoting movements about a generally horizontal axis perpendicular to the carriage direction of travel; and on said carriage, a power plant driving said means for propelling and said means for imparting.

2. The apparatus of claim 1 wherein said means for attaching comprises a clamping means shaped and dimensioned to hold the end of said object immediately behind the lower tip of the blade.

3. The apparatus of claim 1 wherein said means for propelling comprises a wheel on each side of said carriage; and wherein said carriage comprises a pair of handles extending rearwardly from said carriage.

4. The apparatus of claim 1 wherein said clamping means comprise a chinese-finger attached to the apex section of the V-shaped blade.

5. The apparatus of claim 4 which further comprises:

a first clutch mechanism for coupling the power plant to the wheels; and a second clutch mechanism for coupling said power plant to said means for imparting.

6. The apparatus of claim 5 wherein said carriage comprises a horizontal sole plate, and means for holding said sole plate in close proximity to the ground surface and distally from the base of the wheels.

7. The apparatus of claim 6 wherein each of said clutch mechanisms comprises a transmission belt loosely mounted on two pulleys; and means for manually tightening the tension of said belt.

8. The apparatus of claim 7 wherein said means for tightening comprises:

a pivoting arm;

a roller rotating about an axis extending orthogonally from said arm;

a hand-operated lever mounted on the end of one of said handles, a cable connecting said lever to the pivoting arm; and said roller being positioned to apply pressure against the belt when the lever is manually pulled.

* * * * *